US005692683A

United States Patent [19]

Mathis

[11] Patent Number: 5,692,683

[45] Date of Patent: Dec. 2, 1997

[54] INJECTION VALVE FOR A FUEL-INJECTION SYSTEM OF AN INTERNAL COMBUSTION ENGINE, IN PARTICULAR OF A DIESEL MOTOR

[76] Inventor: Christian Mathis, Muttaweg 16, CH-7250 Klosters-Platz, Switzerland

[21] Appl. No.: 432,110

[22] Filed: May 1, 1995

[30] Foreign Application Priority Data

May 2, 1994 [CH] Switzerland ..... 1358/94

[51] Int. Cl.[6] ..... F02M 45/00

[52] U.S. Cl. ..... 239/533.5; 239/584

[58] Field of Search ..... 239/533.3, 533.4, 239/533.5, 584, 91

[56] References Cited

U.S. PATENT DOCUMENTS

| | | | |
|---|---|---|---|
| 4,202,500 | 5/1980 | Keiczek | 239/533.3 |
| 4,531,676 | 7/1985 | Seifert et al. | 239/533.3 X |
| 4,566,635 | 1/1986 | Trachte | 239/533.3 X |
| 4,911,366 | 3/1990 | Prisner | 239/533.3 |
| 4,981,267 | 1/1991 | Scott | 239/533.3 |
| 5,156,132 | 10/1992 | Iwanaga . | |

*Primary Examiner*—Lee W. Young
*Attorney, Agent, or Firm*—Flynn, Thiel, Boutell & Tanis, P.C.

[57] ABSTRACT

An injection valve for a fuel-injection system of an internal combustion engine, in particular of a diesel motor, has a valve housing, a multi-part valve member movably arranged in the housing, and at least one inlet opening terminating in a working cylinder, through which opening fuel is fed from a pressure chamber and which is provided for controlling the valve member by means of an electromagnetic valve. The multi-part valve member is enclosed by a damping chamber filled with fuel in the contact area between its nozzle needle that controls the injection opening and the at least one valve-member part lying thereabove. On one side, approximately clearance-free positioning fits are connected in front of or rather after the damping chamber with one formed between the nozzle needle and the valve housing and on the other side, one being formed between the valve-member part and the valve housing. When the injection valve is closed, a support providing spring force acting on the valve-member part guides same against the nozzle needle until their front sides contact one another, while these move apart when the injection opening is open due to the fuel flowing with a limited flow from the pressure chamber into the damping chamber. With this a significant damping of the nozzle needle is achieved which nozzle needle impacts with an increased closing speed in the valve tip. The damping is achieved since the nozzle tip of the valve tip does not have to absorb the accelerated mass of the valve-member parts lying above the nozzle needle during the direct impact of the nozzle needle.

16 Claims, 3 Drawing Sheets

INJECTION VALVE FOR A FUEL-INJECTION SYSTEM OF AN INTERNAL COMBUSTION ENGINE, IN PARTICULAR OF A DIESEL MOTOR

FIELD OF THE INVENTION

The invention relates to an injection valve for a fuel-injection system of an internal combustion engine, in particular of a diesel motor, comprising a valve housing, a multi-part valve member movably arranged in said valve housing, and further comprising at least one inlet opening ending in a working cylinder, through which inlet opening fuel coming from a pressure chamber is fed for controlling the valve member.

BACKGROUND OF THE INVENTION

An injection valve of this class, for example, according to EP-A1 0 393 590 (U.S. Pat. No. 5,156,132), has a multi-part housing which has been assembled together and a valve member. The valve member is arranged so as to be longitudinally movable in the housing by means of an electromagnetic valve, which valve member includes a nozzle needle controlling the fuel injection and a piston-like extension part arranged coaxial with said nozzle needle. The extension part is composed of one part, which is guided in the housing, and one lower part, which is tapered in diameter. A control valve is provided between the electromagnetic valve and the extension part which at the start of an injection thereby effects a stepped increase of the injected amount of the fuel in an internal combustion cylinder. Moreover, such an injection valve achieves an increased closing speed of the nozzle needle, which provides the positive effect of reducing the exhaust gas emissions of the internal combustion engine, which engine usually has several of these injection valves.

However, because the two-part valve member is relatively long and consequently has a correspondingly large mass, there exists the danger that the nozzle tip will be stressed too much by the nozzle needle during closing of the injection opening and be torn or even broken. This has the result that such tears or breaks cause leakages leading into the internal combustion cylinder.

SUMMARY OF THE INVENTION

The purpose of the present invention, therefore, is to further develop an injection valve according to the above-described class in such a manner that even with an increased closing speed and with a long elongate design of its valve member, the impact force acting onto the nozzle tip during closing does not result in a premature overload of this tip, while at the same time the injection valve is not complicated in its design.

In such a manner, the purpose is attained according to the invention wherein a damping chamber filled with fuel is formed between the nozzle needle controlling the injection opening and at least one of the valve-member parts of the multi-part valve member, which valve-member part lies above the nozzle needle.

This inventive solution serves to achieve a considerable damping of the nozzle needle which impacts in the valve tip with an increased closing speed, since the nozzle tip of the valve tip does not need to absorb its entire accelerated mass during the direct impact of the valve member.

BRIEF DESCRIPTION OF THE DRAWINGS

Preferred embodiments of the invention and further advantages of the same will be discussed in greater detail hereinafter in connection with the drawings, wherein.

DETAILED DESCRIPTION

Figure 1:
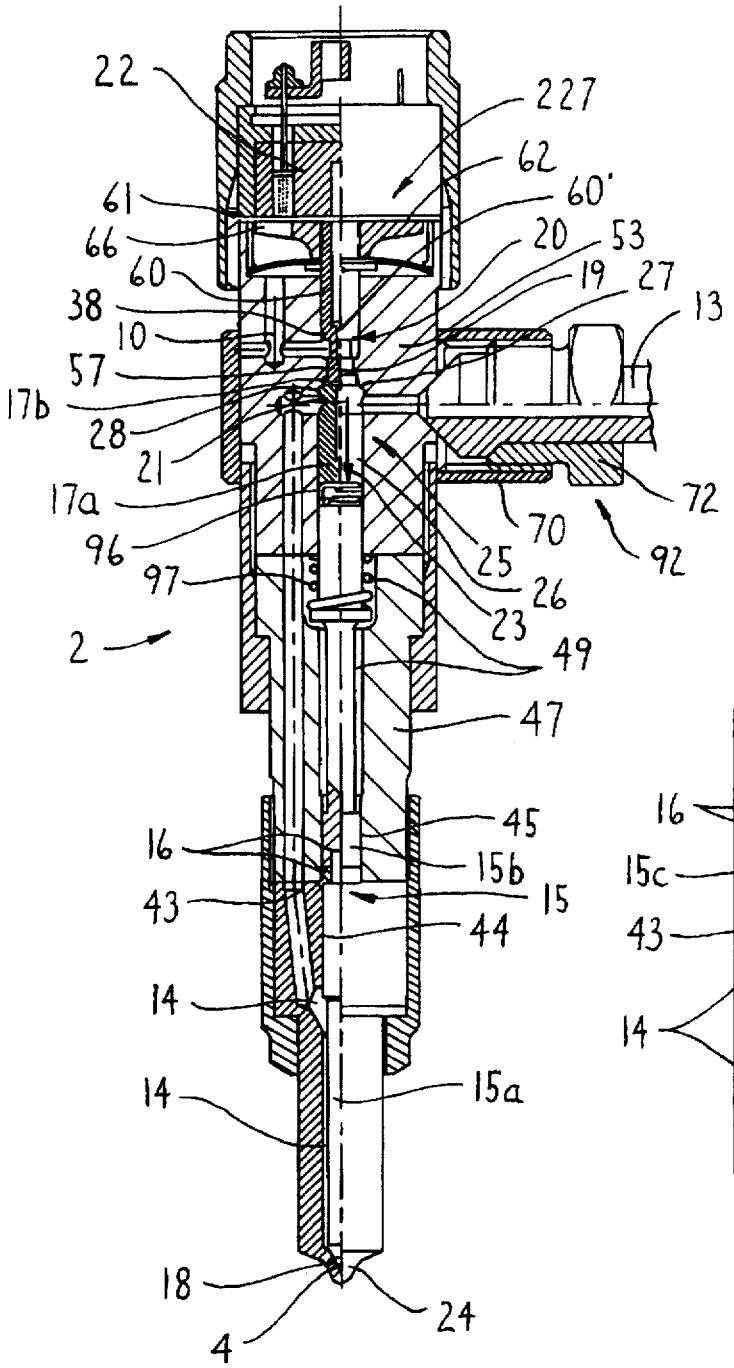
FIG. 1 is a longitudinal cross-sectional view of an injection valve of the invention.

FIG. 1 shows an injection valve 2 for an internal combustion engine, which is in particular a diesel motor (not illustrated). The injection valve 2 is suited for a common injection system of a diesel motor so that a detailed discussion thereof is not needed. It essentially has a multi-part valve housing 47, 53, which may be assembled in a common manner, a multi-part valve member 15 guided so as to be longitudinally movable therein, a control valve 20 operating said valve member 15 and designed as an electromagnetic valve 227, a feed conduit 13 for the fuel under high pressure and a discharge conduit 10.

The multi-part valve member 15 is surrounded at the lower part thereof by a pressure chamber 14 which is fed with fuel from the feed conduit 13. The valve member 15 closes or opens an injection opening 4 or more particularly, the feed conduit 13 leading into a working or combustion cylinder of the diesel motor (not illustrated). The opening 4 or the feed conduit 13 of the opening 4 is housed in the nozzle tip 24 of the valve housing 47, which nozzle tip 24 projects into the working or combustion cylinder. This valve member 15 is guided in the center area thereof in a fitted hole of the valve housing 47 and projects at the upper end thereof into a control chamber 17*a*. The upper end is there supported by a pressure spring 97 and pressed in the closing direction toward the nozzle tip 24. The control chamber 17*a* is connected on one side through the valve 25 and the feed conduit 13 to a high-pressure part housing the fuel and is connected to the discharge conduit 10 on the other side through the conduit part 19 and the control valve 20 closing the conduit part 19.

A connection 92, which is disposed radial with respect to the injection valve 2, is provided for the feed conduit 13. This connection 92 has a connecting ring 70 extending or gripping around the valve housing 47 and a threaded nut 72 pressing the feed conduit 13 against the housing.

Figure 2:
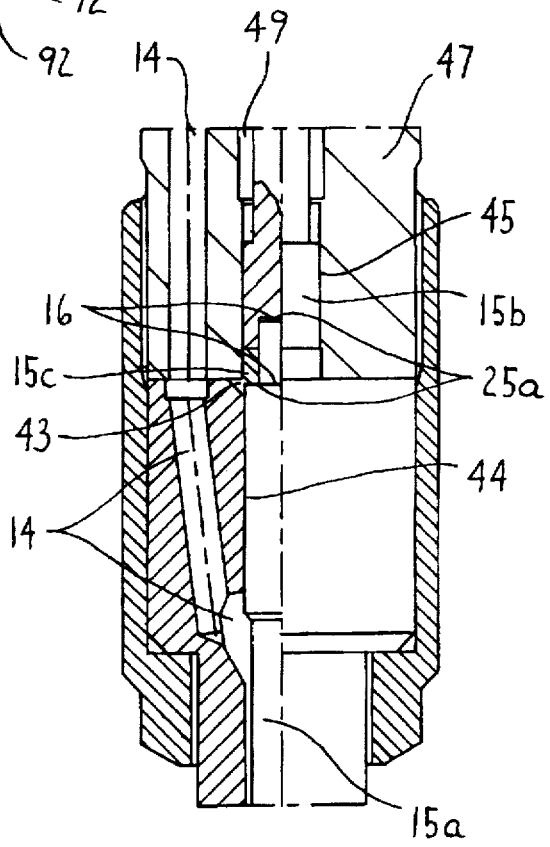
FIG. 2 is a partial longitudinal cross-sectional view of the injection valve according to FIG. 1.

The invention provides a damping chamber 43 between the nozzle needle 15*a* controlling the injection opening 4 and the valve-member part 15*b* of the two-part valve member 15, which valve-member part 15*b* lies above said nozzle needle 15*a*, as has also been clearly shown in the enlarged partial longitudinal cross-sectional view according to FIG. 2. Substantially clearance-free positioning fits 44 and 45 respectively connected in front of or rather after this damping chamber 43, wherein one fit 44 is formed on one side between the nozzle needle 15*a* and the valve housing 47, and one fit 45 is formed on the other side between the valve-member part 15*b* and the valve housing 47. Thus there results a feed into or rather a discharge out of this damping chamber 43 which is limited in its amount and out of or into the adjacent pressure chamber 14 or else a chamber 49.

Besides the already mentioned significant advantage of this protection of the nozzle tip 24 by means of the damping chamber 43, a further advantage results, namely wherein the injection valve 2 can be assembled mainly of common parts and is therefore no more expensive to manufacture than known injection valves.

When the injection valve 2 is closed and in its resting state, the spring force of the pressure spring 97 acts on the valve-member part 15*b* in the direction toward the nozzle needle 15*a*. The spring force guides the front sides 16, 25*a*, which are disposed in the damping chamber 43, until they contact one another before the next injection operation takes place, during which these front sides 16, 25*a* move slowly away from one another after the valve opens. This separating movement is caused by the fuel, which flows with a limited flow from the pressure chambers 14, 49 under high pressure through the respective positioning fits 44, 45 into the damping chamber 43, and because the pressure of the medium in the damping chamber 43 drops almost to the pressure of the surface of the nozzle needle 15*a* on the injection side. When the valve member 15 is subsequently closed, only a direct impact of the relatively light nozzle needle 15*a* in the nozzle tip 24 occurs, so that the valve-member part 15*b*, which is moved also in the closing direction, is cushioned by the liquid cushion formed between said valve-member part 15*b* and the nozzle needle 15*a*, and thus the desired permanent reduction of the maximum stress of the lowermost tip of the injection valve 2 is achieved.

Furthermore the injection valve 2 of the invention in comparison with conventional solutions can increase the safety by continuously supplying the damping chamber 43 with fuel, for example during a jamming of the control valve 20 and the related continuing open state of the injection opening 4. Consequently, the nozzle needle 15*a* drifts away from the valve-member part 15*b* until the injection opening 4 closes.

Furthermore, this damping chamber 43 preferably has a maximum volume, which corresponds approximately with the cross-sectional surface of the nozzle needle 15*a* and a gap height of a maximum of two millimeters.

The control valve 20 is designed as an electromagnetic valve 227 having a control-valve member 38, which closes and opens the conduit part 19 in the valve housing 47, which conduit part 19 is vertical and thereafter moves into a horizontal discharge conduit 10. This control-valve member 38 has a bore 60' extending from its valve seat 57 and communicating with the conduit part 19, which bore 60' is enlarged inside of the control-valve member 38 for the purpose of generating a closing force acting in the closing direction of said control-valve member. For this purpose, this bore 60' is defined on top by a pin 60 arranged coaxially so as to be longitudinally movable in the control-valve member 38. The pin 60 is supported at its upper end independently from the control-valve member 38, in the present example, on the lower front side of a pin which is arranged in the magnetic core 22 and has a sufficient hardness. The magnetic core 22 rests with its lower flat front side directly on the foil plate 61, which in turn is thus fixed on a flat annular surface of the valve housing. Moreover, recesses 66 are provided in the armature 62 and its adjacent parts. Through these recesses 66, a circulation of the fuel surrounding the armature 62 is made possible during movement of the armature 62. By suitably choosing the cross section of the recesses 66, it is possible to adjust the damping action of the back and forth moving control-valve member 38.

A further valve 25 is arranged above this nozzle needle 15 in the illustrated injection valve 2 in order to generate an increased closing speed of the valve member. Through the feed conduit 13, the valve 25 has an annular chamber 28 connected to the high-pressure part of the control medium and an annular valve seat 27 on top on the front side this chamber for closing of the valve 25. This valve seat creates this additional connection during opening between the high-pressure part and the control chamber 17*b*. The valve 25 preferably has a valve member 26 extending coaxially with respect to the nozzle needle 15, which valve member 26 is guided laterally and sealingly in the valve housing 47. This cylindrical valve member 26 and the valve housing 47 together form the annular chamber 28 and the valve seat 27 for closing off this chamber 28. The valve member 26 thereby projects into the control chamber 17*a* with the one front side that is facing the nozzle needle 15 and into a supplementary chamber 17*b* with the other front side which supplementary chamber 17*b* communicates with the discharge conduit 10 via the control valve 20. The supplementary chamber 17*b* is connected to the control chamber 17*a* through a throttle bore 23 passing through the valve member 26 and is bordered on the peripheral side by the valve seat 27. The later is designed such that the valve member 26 rests in the closing state with its upper inclined annular edge sealingly against a corresponding annular surface in the housing bore and the annular chamber 28 surrounds the valve member 26 at least in its upper area. This conically designed valve seat 27 could, however, also be designed cylindrically or as a flat surface. Moreover, the valve member 26 has a transverse throttle bore 21 connecting the feed conduit 13 to the control chamber 17*b*, by means of which a permanent connection or flow of the control medium from the high-pressure part into this control chamber occurs.

In the closing position, the valve member 26 is spaced a predetermined distance from the nozzle needle 15 below it and also has a pressure spring 96 provided between them which presses these apart. In the open position of the nozzle needle 15, which is effected by a release of the control valve 20 and a related pressure drop in the control chamber 17*a*, said nozzle needle 15*a* contacts the lower front side 16 of the valve member 26.

Immediately following the closing of the control valve 20, there takes place on the one hand a pressure build-up first in the supplemental chamber 17*b* due to the transverse throttle bore 21 with the result that the valve member 26 is moved toward the nozzle needle 15*a* and thus the valve seat 27 is automatically opened. This opening of the valve seat 27 causes an additional supply of the control medium, which is under high pressure, to flow into the supplemental chamber 17*b* and thus, the nozzle needle 15*a* is moved by the valve member 26 with an increased speed into the closing position. After having reached the closing position, the valve member 26 is moved back upwardly, due to the pressure build-up in the control chamber 17*a* and the spring-force support of the spring 96, until its upper annular edge is positioned in the housing bore and the valve seat 27 is thus again in the closing position.

Figure 3:
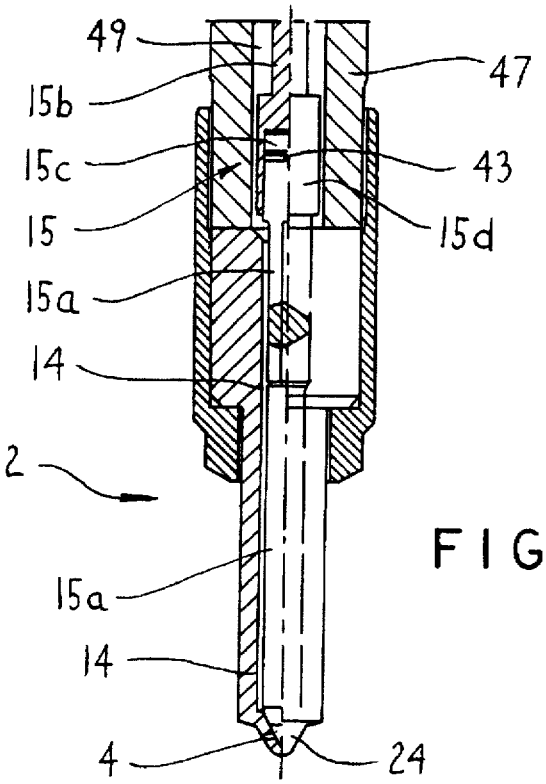
FIG. 3 is a partial longitudinal cross-sectional view of a modification of the injection valve.

In the injection valve 2 according to FIG. 3, the illustrated damping chamber 43 is unlike the first preferred embodiment wherein the damping chamber 43 is directly surrounded by the valve housing 47, but instead the damping chamber 43 is surrounded by an annular element 15*d* which is axially movable in said valve housing wherein the annular element forms the lower end of the valve-member part 15*b*. The nozzle needle 15*a*, which in turn opens or closes the inlet opening 4, extends approximately clearance-free into this annular element 15*d* and defines the damping chamber 43 together with a spacer 15*c* arranged longitudinally movably above it in the annular element 15. By suitably choosing the length of the spacer 15*c*, the longitudinal tolerances of the length created by the valve member 15 together with the valve member 26 and the corresponding length created by the housing parts 47, 53 can be balanced. The nozzle needle 15*a* has an indicated out of round cross section at least in the lower area thereof, thus forming an open space in the round bore of the valve housing for the pressure chamber. This injection valve 2 otherwise functions like the one according to FIG. 1 and all details are therefore not discussed again. In addition to the one according to FIG. 1, the injection valve 2 of FIG. 3 has the advantage in that it has a smaller number of surfaces to be ground and an exact positioning fit in the housing 47 is not needed. Thus, it can be manufactured of a tougher material and in addition, a high-frequency vibrating stroke course of the nozzle needle 15*a* is produced.

Figure 4:
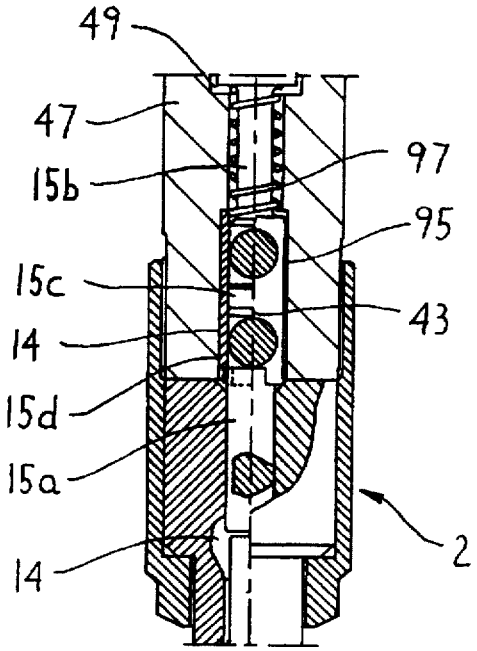
FIG. 4 is a partial longitudinal cross-sectional view of another modification of the injection valve.

FIG. 4 illustrates a further modification of an injection valve 2 in the part which is important for the invention. It is actually designed similarly to the one according to FIG. 3, however, the annular element 15*d* is here provided separately from the upper valve-member part 15*b*. The upper valve-member part 15*b* and the nozzle needle 15*a* are guided substantially clearance-free in the annular element 15*d* with a round design. The invention again provides a damping chamber 43 that is formed between the nozzle needle 15*a* and the valve-member part 15*b*. The annular element 15*d* surrounding said damping chamber is designed as a pipe which seals on the inside and can with a correspondingly thin wall also be formed of plastic instead of a metal material. It is placed over the two ends of the nozzle needle 15*a* and of the valve-member part 15*b* and forms a fixed seat together with same. The damping function of the valve member 15 is in this manner slightly reduced. However, this injection valve can be manufactured inexpensively and the annular element 15*d* inserted therein can transmit tensile forces and carries out a slightly jointed function. When this annular element 15*d* is ground on the inside and is not mounted on the nozzle needle 15*a* and on the valve-member part 15*b*, then the pressure spring 97 engaging said valve-member part on the front side is used for positioning the same.

Figure 5:
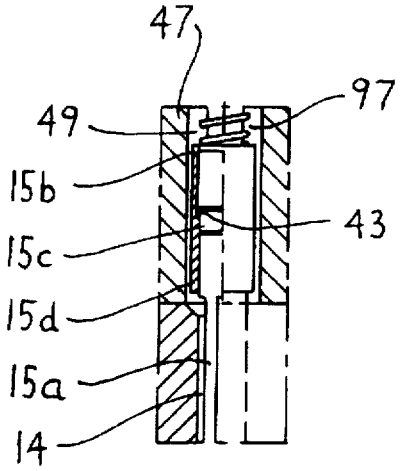
FIG. 5 is a partial longitudinal cross-sectional view of a further modification of the injection valve.

The injection valve according to FIG. 5 has an annular element 15*d* similar to the one according to FIG. 4, which has on the inside a different diameter in the area connected to the nozzle needle 15*a* compared with the one connected to the valve-member part 15*b*. It is supported at its upper front side by the pressure spring 97. The guide cross section of the valve-member part 15*b* is in the illustrated preferred embodiment larger in the annular element 15*d* than the one of the nozzle needle 15*a*. With this a complete opening stroke of the nozzle needle 15*a* is achieved with small superposed vibrations and the movement energy of the valve-member part 15*b* is transferred onto the annular element 15*d* during closing by the stop surface formed by the diameter reduction of said annular element.

The damping chamber 43 basically could be connected additionally to the pressure chamber through each one throttle bore that is connected parallel to the positioning fits.

The control medium flowing into the control chambers is usually a fuel, which is also injected into the storage chamber and thereafter through the injection openings into a fuel cylinder. In principle, however, a separate fluid could be used as the control medium, whereas the fuel would only be provided for the injection.

Figure 6:
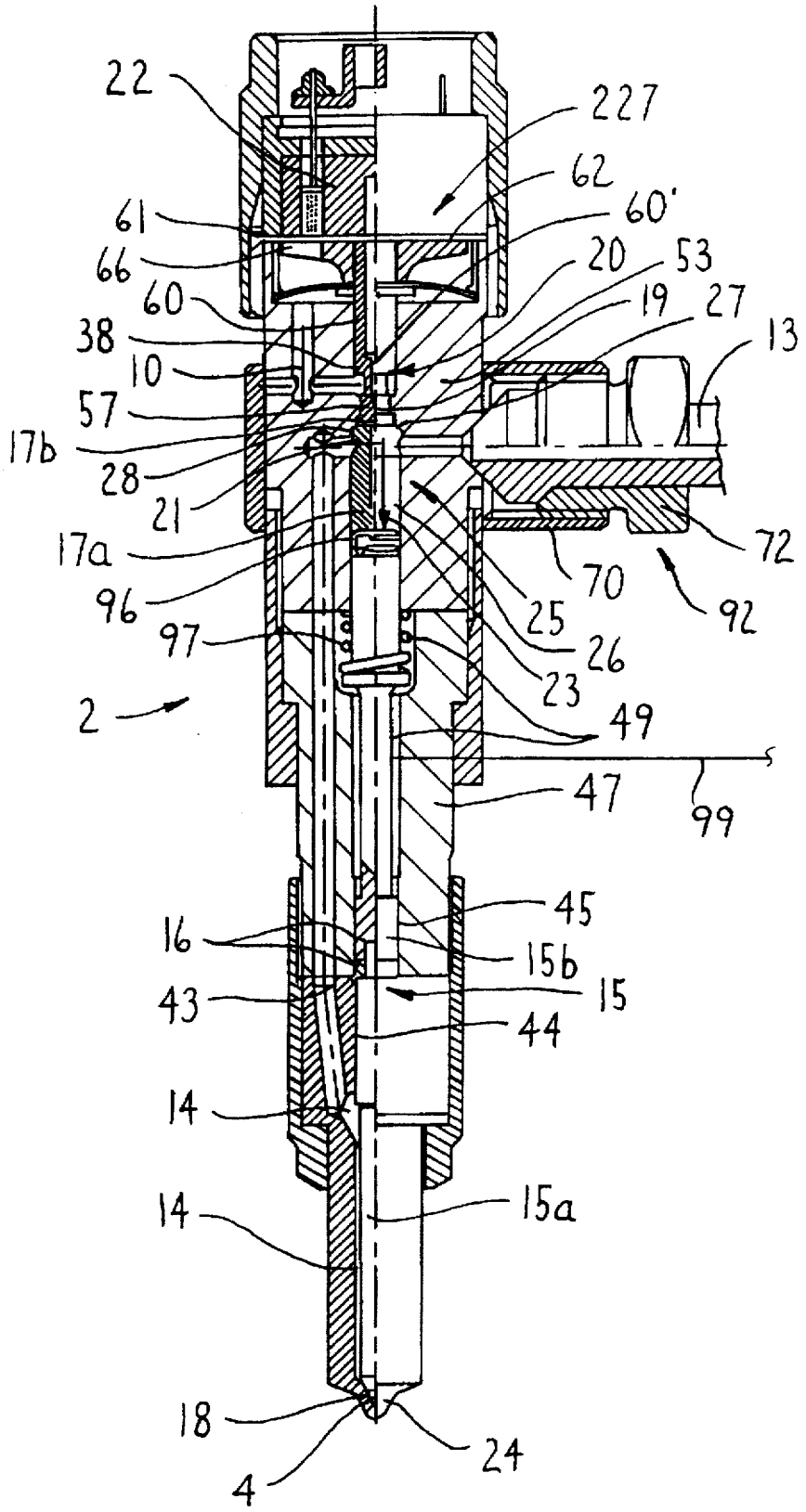
FIG. 6 is a longitudinal cross-sectional view of the injection valve diagrammatically illustrating an oil-leakage feedback.

Furthermore, the damping chamber 43 could be connected to a leakage-oil feedback conduit 99 leading away from the injection valve and having a lower pressure than the pressure chamber. The feedback 99 is diagrammatically illustrated in FIG. 6.

The pressure chamber 49 principally could have a lower pressure corresponding with the discharge conduit 10. The inventive effect of the damping is guaranteed when the passage cross section formed by the positioning fit 45 when compared with the one formed by the positioning fit 44 is no more than ten times larger.

The invention is sufficiently disclosed with the above-discussed preferred embodiments. It is conceivable as a supplementing modification that the nozzle needle 15*a* could be designed in two parts wherein the damping chamber would be arranged above this two-part nozzle needle.

The embodiments of the invention in which an exclusive property or privilege is claimed are defined as follows:

1. In an injection valve for a fuel-injection system of an internal combustion engine, said injection valve comprising a hollow valve housing, a multi-part valve member arranged movably therein, and further comprising at least one injection opening terminating in a working cylinder and a pressure chamber which is in communication with said injection opening and includes fuel therein, said fuel coming from said pressure chamber and being supplied through said injection opening by controlling the valve member, comprising the improvement wherein said valve member includes a nozzle needle which is removably seated in said injection opening for opening and closing said injection opening and at least one valve-member part disposed in said valve housing above said nozzle needle, said valve member including a damping chamber filled with fuel received from said pressure chamber which is formed between the nozzle needle controlling the injection opening and said at least one valve-member part of the multi-part valve member.

2. The injection valve according to claim 1, wherein substantially clearance-free first and second positioning fits are respectively connected in front of the damping chamber on a side toward said injection opening and after the damping chamber on a side away from said injection opening, said first positioning fit being formed between the nozzle needle and the valve housing in front of said damping chamber, and said second positioning fit being formed between the at least one valve-member part and the valve housing after said damping chamber, and wherein said damping chamber is connected to the pressure chamber housing the fuel.

3. The injection valve according to claim 1, wherein said valve member includes a spring member acting on said at least one valve-member part such that when the injection valve is closed, a spring force acting onto the at least one valve-member part guides said at least one valve-member part against the nozzle needle until respective opposing sides of said at least one valve-member part and said nozzle needle contact one another, and when the injection opening is open, said at least one valve-member part and said nozzle needle move slowly apart due to the fuel flowing from the pressure chamber into the damping chamber.

4. The injection valve according to claim 1, wherein said damping chamber is connected through at least one positioning fit to a conduit leading away from the injection valve, said conduit having a lesser pressure than the pressure chamber.

5. The injection valve according to claim 1, wherein the damping chamber is directly enclosed by the valve housing or by an annular element axially movable or stationary in said valve housing.

6. The injection valve according to claim 5, wherein the annular element is guided as a part of the valve-member part or independently from the valve housing.

7. The injection valve according to claim 5, wherein in the annular element, the nozzle needle and a spacer arranged in said annular element are guided approximately clearance-free, and the damping chamber surrounds the spacer.

8. The injection valve according to claim 6, wherein in the area projecting into the damping chamber the nozzle needle has a different, either greater or smaller cross section than the area of the adjoining at least one valve-member part.

9. The injection valve according to claim 8, wherein the cross section of the at least one valve-member part in the annular element is larger than the cross section of the nozzle needle, said annular element including a reduction in an interior diameter thereof which defines a stop surface facing towards said at least one valve-member part and thus during closing the movement energy of the valve-member part is transmitted onto the annular element through the stop surface formed by the diameter reduction of said annular element.

10. An injection valve for a fuel-injection system of an internal combustion engine comprising:

a valve housing having a hollow interior, an injection opening at one end thereof in communication with said hollow interior, and a pressure chamber which includes fuel therein and is in communication with said injection opening for supplying said fuel to said injection opening; and a multi-part valve member movably disposed within said hollow interior, said valve member including a nozzle needle which is removably seated within said injection opening and is movable outwardly toward and inwardly away from said injection opening to respectively close and open said injection opening, said valve member further including at least one valve-member part which is disposed in said hollow interior inwardly of said nozzle needle and is movable toward and away from said nozzle needle, said valve member further including control means for moving said valve member to open and close said injection opening, a damping chamber disposed between said nozzle needle and said at least one valve-member part, and supply means for supplying a pressurized fluid to said damping chamber to form a cushion of said pressurized fluid between said at least one valve-member part and said nozzle needle during closing of said injection opening by said nozzle needle.

11. The injection valve according to claim 10, wherein said supply means includes a first passage which is in communication with said pressure chamber, said pressurized fluid in said damping chamber being said fuel which flows through said first passage between said pressure chamber and said damping chamber.

12. The injection valve according to claim 11, wherein said pressure chamber is disposed proximate said nozzle needle at said injection opening, said first passage comprising a first substantially clearance-free fit which is formed between an exterior surface of said nozzle needle and an opposing interior surface of said hollow interior of said valve housing and extends longitudinally between said pressure chamber and said damping chamber.

13. The injection valve according to claim 12, wherein said first substantially clearance-free fit is disposed on an outward side of said damping chamber between said damping chamber and said injection opening.

14. The injection valve according to claim 11, wherein said pressure chamber is a first pressure chamber and a second pressure chamber is disposed inwardly away from said damping chamber proximate said at least one valve-member part, said damping chamber being in communication with said second pressure chamber by a second passage extending therebetween.

15. The injection valve according to claim 14, wherein said first passage comprises a first substantially clearance-free fit formed between an exterior surface of said nozzle needle and an opposing interior surface of said hollow interior of said valve housing, said second passage comprising a second substantially clearance-free fit formed between an exterior surface of said at least one valve-member part and said opposing interior surface of said valve housing.

16. The injection valve according to claim 10, wherein said nozzle needle and said at least one valve-member part have respective opposing ends which define said damping chamber therebetween and are disposed in contact one with the other when said injection opening is closed by said nozzle needle, said pressurized fluid being supplied to said damping chamber to separate said respective opposing ends when said nozzle needle is moved away from said injection opening.

* * * * *